United States Patent [19]

Naudet et al.

[11] Patent Number: 4,730,983

[45] Date of Patent: Mar. 15, 1988

[54] SYSTEM FOR ATTACHING A ROTOR BLADE TO A ROTOR DISK

[75] Inventors: Jacky Naudet, Bondoufle; Jean-Louis Bertrand, Melun, both of France

[73] Assignee: Societe Nationale d'Etude et de Construction de Moteurs d'Aviation "SNECMA", Paris, France

[21] Appl. No.: 89,414

[22] Filed: Aug. 26, 1987

[30] Foreign Application Priority Data

Sep. 3, 1986 [FR] France ..... 86 12357

[51] Int. Cl.[4] ..... F01D 5/32

[52] U.S. Cl. ..... 416/220 R; 416/221

[58] Field of Search ..... 416/219 R, 220 R, 221

[56] References Cited

U.S. PATENT DOCUMENTS

| | | | |
|---|---|---|---|
| 3,096,074 | 7/1963 | Pratt et al. | 416/221 |
| 3,300,179 | 1/1967 | Gooderum | 496/221 |
| 3,397,865 | 8/1968 | Catlow et al. | 416/221 |
| 3,656,865 | 4/1972 | Spears | 416/220 R |
| 3,807,898 | 4/1974 | Guy et al. | 416/220 |
| 4,019,833 | 4/1977 | Gale | 416/220 R |
| 4,108,571 | 8/1978 | Mawson | 416/221 |
| 4,275,990 | 6/1981 | Langley et al. | 416/220 R X |
| 4,389,161 | 6/1983 | Brumen | 416/220 R |
| 4,523,890 | 6/1985 | Thompson | 416/95 |

FOREIGN PATENT DOCUMENTS

| | | | |
|---|---|---|---|
| 1428230 | 1/1969 | Fed. Rep. of Germany | 416/221 |
| 1060172 | 3/1954 | France . | |
| 1307564 | 9/1962 | France . | |
| 2501283 | 9/1982 | France . | |
| 2524933 | 10/1983 | France . | |
| WO87/01761 | 3/1987 | PCT Int'l Appl. . | |
| 905582 | 9/1962 | United Kingdom . | |
| 954323 | 4/1964 | United Kingdom . | |
| 988541 | 4/1965 | United Kingdom | 416/220 R |
| 1295003 | 11/1972 | United Kingdom | 416/220 R |
| 1512882 | 6/1978 | United Kingdom . | |
| 2010404 | 6/1979 | United Kingdom | 416/220 R |
| 533738 | 10/1976 | U.S.S.R. | 416/220 R |

*Primary Examiner*—Everette A. Powell, Jr.

*Attorney, Agent, or Firm*—Bacon & Thomas

[57] ABSTRACT

A locking and sealing system is disclosed for attaching a rotor blade to a rotor blade disk in a turbojet engine. The system has a first split ring member which locks the rotor blade foot portion onto the rotor blade disk. A second split ring member is inserted between the first split ring member in a downstream flange of the rotor blade foot portions to provide a positive seal to prevent air leakage between the foot portions and the notches formed in the rotor disk.

13 Claims, 2 Drawing Figures

SYSTEM FOR ATTACHING A ROTOR BLADE TO A ROTOR DISK

BACKGROUND OF THE INVENTION

The present invention relates to turbojet engines, more particularly a system for attaching a rotor blade to a rotor disk for such engines.

It is well known in the art to attach rotor blades to a turbine rotor disk of a turbojet engine by axially inserting a foot portion of the rotor blade into a notch defined in the periphery of the rotor disk. However, this system of assembly typically causes two problems: first, it has been virtually impossible to axially lock each rotor blade in the rotor disk in a manner which not only allows a single blade or the entire blade set to be disassembled and, at the same time reliably retains the blades in their locked positions; second, sealing between the upstream and downstream zones on either side of the rotor disk has been difficult to achieve effectively, thereby lowering the efficiency of the turbojet engine. The spaces between the notches formed in the rotor disk and the foot portions of the rotor blades can, if not properly sealed, allow substantial quantities of air to move beneath the blade feet from a downstream position and recirculate toward the upstream of the compressor thereby lowering the compression ratio of the compressor and resulting in a decrease in the overall efficiency of the tubojet engine.

It is known to axially position the rotor blades relative to the rotor disk by the engagement of a flange formed on the rotor blade with the upstream surface of the rotor disk and to lock the blade into position by an elastically deformable split ring. Typically, the split ring is radially compressed during assembly so that it can be inserted into an opening in the rotor disk. The split ring then expands inside an annular groove formed in the rotor disk and in the blade feet.

In another system, illustrated in French Pat. No. 2,501,283, a ring is notched so as to simultaneously enter a circular slot formed in the rotor disk and in slots formed in the blade flanges. The ring is then rotated slightly such that a solid portion of the ring engages the slots formed in the blade flanges and the slot in the rotor disk. While such a system is effective at locking the rotor blades, it suffers from the drawback of poorly sealing the air at the interface of the blade feet and the rotor disk notch.

The system shown in British Pat. No. 1,512,882 attempts to solve this problem by using ring-sealed plates cooperating with a circular groove in the rotor disk and with grooves on the blade platforms. An O-ring in the rotor disk groove cooperates with a frusto-conical surface on the plates to compress them by centrifugal action against the platform grooves. Such an arrangement improves the sealing in the area of the blade feet, but presents difficulties in relation to small-diameter compressor rotor disks. Furthermore, this system requires a large number of parts, thereby increasing the complexity of the installation and maintenance.

SUMMARY OF THE INVENTION

An object of the invention is to alleviate the foregoing problems of the prior art devices by using a system for attaching a rotor blade to a rotor disk having a minimal number of parts that simultaneously provide sealing at the foot of the blade and axially lock the blades onto the rotor disk.

Another object is to provide such a system which is compatible with small-diameter rotor disks, such as those utilized in aircraft-turbine engines, in turbojet engines with un-faired counter-rotating propellers (prop fans), in turbojet engines with faired counter-rotating propeller, or in other aircraft gas-turbine engines.

The objects of the invention are achieved in a gas-turbine engine having at least one rotor disk with notches formed on its periphery in which are mounted rotor blades having foot portions received in the rotor disk notches. The notches extend substantially parallel to a longitudinal axis of the turbine engine, although they may be slightly inclined thereto. The foot portions of the rotor blade have an upstream flange mounted thereon which engages an upstream surface of the rotor disk to properly axially position the rotor blades with respect to the disk. A rear or downstream flange is also provided on the foot portions of the rotor blades and defines a substantially circumferentially extending groove which opens radially inwardly toward the axis of the rotor. The rotor disk, in turn, defines a second substantially circumferentially extending groove which opens in a radially outward direction.

A locking means is provided to effectively axially lock and seal the foot portions of the rotor blades in the rotor disk. The locking means is located on the downstream side of the rotor disk and comprises first and second split ring members which cooperate with the grooves formed on the downstream flange and the rotor disk to lock the blades in position. The sum of the axial thicknesses of the first and second split ring members is substantially equal to the thickness of the first grooves formed by the downstream flanges of the rotor blades.

The invention also encompasses a method for assembling the attachment system whereby a first end of the first split ring member is displaced from the plane of the member and circumferentially inserted into the grooves defined by the downstream flanges of the rotor blades and the groove formed in the rotor disk. The first split ring member is circumferentially rotated in the grooves until a second notch is in alignment with one of the first notches formed in the periphery of the rotor disk. A rotor blade is axially inserted into the first notch until the upstream flange contacts an upstream surface of the rotor wheel. The first ring is then rotated until the second notch is in alignment with an adjacent first notch. This rotation causes a solid portion of the first ring member to engage the groove defined by the downstream flange member of the initially inserted rotor blade so as to lock it in position. These steps are continued until all of the rotor blades have been inserted and locked into the rotor wheel. A second split ring member is then inserted into the grooves defined by the foot portions of the rotor blades between the first split ring member and the downstream flange of the foot portion to seal the blade/disk interface.

DETAILED DESCRIPTION OF THE PREFERRED EMBODIMENT

Figure 1:
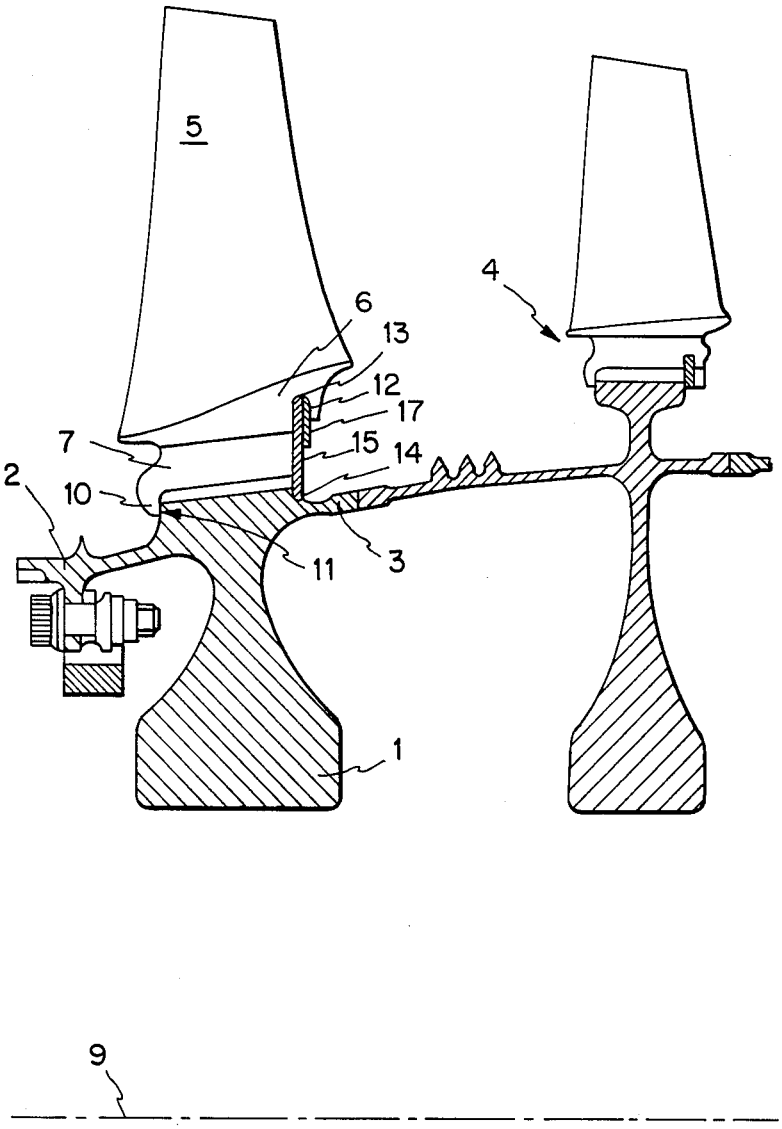
FIG. 1 is a partial, longitudinal sectional view of a rotor disk and rotor blade incorporating the locking system according to the invention.
Figure 2:
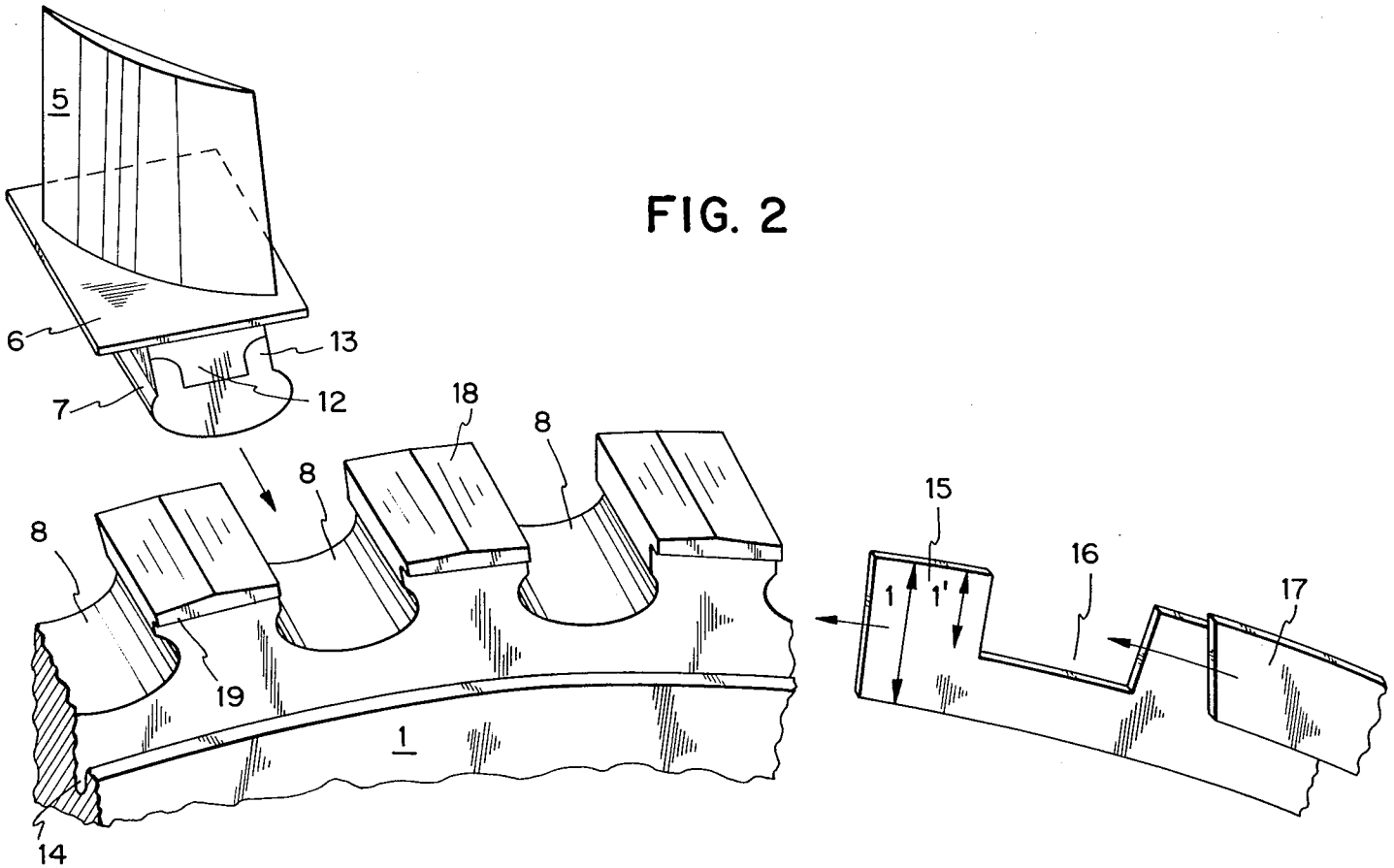
FIG. 2 is a partial, perspective, exploded view showing a portion of a rotor blade disk , a rotor blade and the split ring members according to the invention.

FIG. 1 shows a partial, longitudinal, sectional view of the first two stages of a high-pressure compressor rotor of a turbojet engine. The first stage includes a rotor disk 1 attached by upstream flange 2 to a low or average pressure compressor stage (not shown) and by downstream flange 3 to the second rotor stage denoted generally at 4. Each of the rotor blades 5 have foot portions 7 beneath their platforms 6 which are axially slidably received in notches 8 formed in the periphery of rotor disk 1, as illustrated in FIG. 2. The longitudinal axis of notches 8 may be slightly inclined with respect to the longitudinal axis 9 of the turboject engine within a radial plane. This axis may also be inclined slightly relative to the longitudinal axis 9 in a plane which is tangential to the rim of the rotor disk 1. Although the invention will be described in conjunction with such axes of the notches 8 extending substantially parallel to the longitudinal axis 9, slight angular variations are believed to be encompassed by the term "substantially axial" and are within the scope of the invention.

Each of the blade feet 7 has an upstream flange 10 which extends radially inwardly and serves to axially locate the rotor blade 5 with respect to the rotor disk 1 by contact with the upstream side 11 of the rotor wheel 1.

Each of the rotor blades is also provided with a downstream flange 12 which defines, between itself and the downstream end of the blade foot 7, an annular groove 13 which opens radially inwardly toward the longitudinal axis 9. Opposite groove 13, rotor wheel 1 defines annular groove 14 which opens radially outwardly. Groove 14 has a diameter smaller than the diameter subtended by the radially innermost portions of the notches 8.

The locking and sealing means according to the invention comprises a first split ring member 15 having a radial dimension "I" which is substantially equal to the radial distance between the bottoms of grooves 13 and 14. First split ring member 15 may undergo both a slight radial and a slight axial deformation such that the ends of the split ring may be displaced from the plane of the ring. When one end of the first split ring 15 is thusly displaced, it may be placed in the grooves 13 and 14 and the rest of the split ring member may be inserted into these grooves by subsequently rotating the ring about the longitudinal axis 9.

Once inserted in position, the first split ring 15 will entirely cover the downstream openings of notches 8. To allow the sequential insertion of the foot portion 7 of blades 5 into their respective notches 8, split ring member 15 defines a substantially rectangular second notch 16 which opens in a radially outward direction as illustrated in FIG. 2. When second notch 16 is aligned with one of the first notches 8 formed in the rotor wheel, the foot portion 7 of rotor blade 5 may be axially slid into notch 8 until the upstream flange 10 bears against upstream surface 11 of rotor wheel 1. In this position, as shown in FIG. 1, annular groove 13 is in axial alignment with the split ring member 15. The split ring member 15 is then rotated until the second notch 16 is in alignment with an adjacent first notch 8. By this rotation, a solid portion of the split ring member 15 will pass into the groove 13 to retain blade 5 in its assembled position. The intermittent rotation of split ring member 15 is continued until each of the rotor blades 5 has been inserted into the respective notches around the entire periphery of rotor disk 1.

The locking device according to the invention also comprises a second split ring member 17 sized such that its outer diameter is substantially equal to the diameter defined by the bottoms of blade grooves 13. The sum of the axial thicknesses of the second split ring 17 and the first split ring 15 is substantially equal to the axial thickness of the blade groove 13. The second split ring member 17 is formed of a resilient material such that it may be radially compressed and placed against the first split ring member 15. Upon release, its resiliency causes it to radially expand and enter the grooves 13 of each of the rotor blades 5 between the first split ring member 15 and the downstream flange 12. The radial dimension of the second split ring member 17 is equal to or greater than the radial dimension "I" of the second notch 16 formed in the first split ring member 15 in order that the second split ring member 17 will completely cover this notch once it has been installed. This effectively provides a complete seal between the foot portions 7 and the notches 8 defined in rotor wheel 1. During operation, the centrifugal forces exerted on second split ring member 17 serve to hold it in its proper location. Quite obviously, the locking device and the rotor blades may be disassembled by reversing the assembly order described above.

FIGS. 1 and 2 illustrate that the first split ring member 15 entirely covers the leakage areas which, in the absence of the split ring member, would be present between the blade feet 7 and the bottoms of notches 8. In FIG. 2, the rotor disk is shown having teeth 18 separating notches 8 wherein the teeth have radially inwardly opening grooves defined by downstream flange 19 which are in alignment with the grooves 13 formed on the blade feet 7. However, these downstream flanges 19 may be eliminated to simplify the manufacture of the rotor disk without any deleterious effects of the locking and sealing system.

Rotation of first split ring member 15 may be prevented by a locking pin or the like and may be located such that second notch 16 is located adjacent one of the teeth 18. This location, along with the coverage of second split ring member 17 eliminates any possibility of air leakage through the notch 16.

The foregoing is provided for illustrative purposes only and should not be construed as in any way limiting this invention, the scope of which is defined solely by the appended claims.

What is claimed is:

1. A system for removably attaching and sealing a rotor blade to a rotor disk for a turbojet engine having a longitudinal axis comprising:

(a) a plurality of substantially axially extending notches defined in the periphery of the rotor disk;

(b) a foot formed on each rotor blade and adapted to be substantially axially slidably received in a notch of the rotor disk, the foot having thereon locating means to axially locate the foot with respect to the rotor disk, and a downstream flange defining a substantially circumferentially extending first groove opening radially inwardly;

(c) a substantially circumferentially extending second groove defined by the rotor disk, the second groove opening radially outwardly; and (d) locking means to axially lock and seal the blade foot to the rotor disk comprising:

(i) a first split ring member adapted to engage the first and second grooves; and, (ii) a second split ring member adapted to engage only the first grooves such that the sum of the axial thicknesses of the first and second members is substantially equal to the axial thickness of the first grooves.

2. The attaching system according to claim 1 wherein the first split ring member defines a radially outwardly opening second notch to allow axial insertion of the blade foot.

3. The attaching system according to claim 2 wherein the second notch has a substantially rectangular shape.

4. The attaching system according to claim 2 wherein a radial dimension of the first split ring member is substantially equal to the radial distance between bottoms of the first and second grooves.

5. The attaching system according to claim 4 wherein the diameter of the second groove is less than a diameter subtended by the radially innermost portions of the notches in the rotor disk.

6. The attaching system according to claim 1 wherein the second split ring member is formed of resilient material to allow radial compression and extension.

7. The attaching system according to claim 2 wherein the second split ring member is formed of resilient material to allow radial compression and extension.

8. The attaching system according to claim 7 wherein the second notch has a radial dimension I' and wherein a radial width of the second split ring member is equal to or greater than I'.

9. The attaching system according to claim 8 wherein the second notch has a substantially rectangular shape.

10. The attaching system according to claim 2 wherein a radial dimension of the first split ring member is substantially equal to the radial distance between bottoms of the first and second grooves.

11. The attaching system according to claim 10 wherein the diameter of the second groove is less than a diameter subtended by the radially innermost portions of the notches in the rotor disk.

12. A method of assembling, locking and sealing a rotor blade having a foot portion to a rotor wheel having a plurality of first notches defined by its periphery comprising the steps of:

(a) displacing a first end of a first split ring member from the plane of the member;

(b) circumferentially inserting the displaced end into a groove formed in the rotor disk and rotating the first split ring member until a second notch in the first split ring member is aligned with a first notch;

(c) inserting the foot portion of the rotor blade into the first notch;

(d) rotating the first split ring member until the second notch is aligned with a subsequent first notch causing the first split ring member to engage a groove formed in the foot of the inserted rotor blade to lock it in position;

(e) repeating steps (c) and (d) until a rotor blade is inserted and locked in each first notch formed in the rotor disk; and, (f) inserting a second split ring member into the grooves defined by the foot portions of the blade between the first split ring member and a downstream portion of the blade foot.

13. The method according to claim 12 comprising the additional step of radially compressing the second split ring member before inserting it into the grooves defined by the foot portions of the blade.

* * * * *

UNITED STATES PATENT AND TRADEMARK OFFICE

CERTIFICATE OF CORRECTION

PATENT NO. : 4,730,983

DATED : March 15, 1988

INVENTOR(S) : NAUDET ET AL

It is certified that error appears in the above—identified patent and that said Letters Patent is hereby corrected as shown below:

Col. 3, line 15, please delete "turboject" and insert --turbojet--.

Signed and Sealed this

Ninth Day of August, 1988

*Attest:*

DONALD J. QUIGG

*Attesting Officer*

*Commissioner of Patents and Trademarks*